US007107921B2

(12) United States Patent
Davis et al.

(10) Patent No.: US 7,107,921 B2
(45) Date of Patent: Sep. 19, 2006

(54) END PORTION FOR A FLEXIBLE FLUID CONTAINMENT VESSEL AND A METHOD OF MAKING THE SAME

(75) Inventors: Trent W. Davis, Mansfield, MA (US); Mary M. Toney, Wrentham, MA (US)

(73) Assignee: Albany International Corp., Albany, NY (US)

( * ) Notice: Subject to any disclaimer, the term of this patent is extended or adjusted under 35 U.S.C. 154(b) by 721 days.

(21) Appl. No.: 10/016,724

(22) Filed: Oct. 30, 2001

(65) Prior Publication Data

US 2003/0081861 A1 May 1, 2003

(51) Int. Cl.
*B63B 25/08* (2006.01)

(52) U.S. Cl. ..... 114/74 R; 114/74 T; 114/256; 220/560

(58) Field of Classification Search ..... 114/256, 114/74 R, 74 T; 220/560
See application file for complete search history.

(56) References Cited

U.S. PATENT DOCUMENTS

| | | | | |
|---|---|---|---|---|
| 34,426 | A | 2/1862 | Howard | |
| 389,615 | A | 9/1888 | Townsend | |
| 1,723,307 | A | 8/1929 | Sipe | |
| 1,921,015 | A | 8/1933 | Young | |
| 2,065,480 | A | 12/1936 | Soper | |
| 2,371,404 | A | 3/1945 | Mumford | |
| 2,391,926 | A | 1/1946 | Scott | |
| 2,492,699 | A | 12/1949 | Houwink | |
| 2,613,169 | A * | 10/1952 | Cunnigham | 156/69 |
| 2,640,493 | A * | 6/1953 | Millard | 137/571 |
| 2,685,964 | A | 8/1954 | Brown | |
| 2,724,358 | A | 11/1955 | Harris et al. | |
| 2,725,027 | A | 11/1955 | Brandon et al. | |
| 2,794,192 | A | 6/1957 | Paris | |
| 2,854,049 | A | 9/1958 | Wyllie | |
| 2,968,272 | A | 1/1961 | Berglund | |
| 2,979,008 | A | 4/1961 | Whipple | |
| 2,997,973 | A | 8/1961 | Hawthorne et al. | |
| 2,998,793 | A | 9/1961 | Hawthorne et al. | |
| 3,001,501 | A | 9/1961 | Hawthorne et al. | |
| 3,018,748 | A | 1/1962 | Denis et al. | |
| 3,056,373 | A | 10/1962 | Hawthorne et al. | |
| 3,067,712 | A | 12/1962 | Koerpinghaus | |
| 3,150,627 | A | 9/1964 | Stewart et al. | |
| 3,167,103 | A | 1/1965 | Hawthorne et al. | |
| 3,178,050 | A * | 4/1965 | Doerpinghaus | 220/4.13 |
| 3,224,403 | A | 12/1965 | Paddington | |
| 3,282,361 | A | 11/1966 | Mackie | |

(Continued)

FOREIGN PATENT DOCUMENTS

DE 198 21 465 A 11/1999

(Continued)

OTHER PUBLICATIONS

International Search Report issued by European Patent Office for corresponding international application PCT/US02/10586 mailed Sep. 26, 2002.

(Continued)

*Primary Examiner*—Sherman Basinger
(74) *Attorney, Agent, or Firm*—Frommer Lawrence & Haug LLP; Ronald R. Santucci

(57) ABSTRACT

A flexible fluid containment vessel fabricated out of a fabric for transporting and containing a large volume of fluid, particularly fresh water, having a tapered front and/or rear portions on which an end portion is affixed in the form of a clamping mechanism sealing the same.

12 Claims, 3 Drawing Sheets

U.S. PATENT DOCUMENTS 3,289,721 A 12/1966 Benson
3,296,994 A 1/1967 Schirtzinger
3,502,046 A 3/1970 Stauber
3,622,437 A 11/1971 Hobaica et al.
3,661,693 A 5/1972 Pierson
3,672,319 A 6/1972 Platzer
3,739,410 A 6/1973 Fortin
3,762,108 A 10/1973 Pierson
3,774,563 A 11/1973 Anderson, Sr. et al.
3,779,196 A * 12/1973 Knaus et al. ..... 114/74 T
3,797,445 A 3/1974 Zeimer
3,812,805 A 5/1974 Forssell et al.
3,839,977 A 10/1974 Bradberry
3,952,679 A 4/1976 Grihangne
3,955,524 A 5/1976 Renoux
3,974,789 A 8/1976 DeGroot
4,108,101 A 8/1978 Schirtzinger
4,227,474 A 10/1980 Ullrich
4,227,477 A 10/1980 Preus
4,227,478 A 10/1980 Preus
4,230,061 A 10/1980 Roberts
4,373,462 A 2/1983 Fish
4,399,765 A 8/1983 Alkner et al.
4,506,623 A 3/1985 Roper et al.
4,509,558 A 4/1985 Slater
4,510,201 A 4/1985 Takeuchi et al.
4,582,756 A 4/1986 Niinuma et al.
4,662,386 A 5/1987 Pedersen
4,726,986 A 2/1988 Cannady, Jr. et al.
4,910,817 A 3/1990 Kita
4,933,231 A 6/1990 Seber
4,948,658 A 8/1990 Haelker
4,998,498 A 3/1991 Gallichan
5,082,726 A 1/1992 Bastiaens et al.
5,194,459 A 3/1993 Sato et al.
5,203,272 A 4/1993 Kassinger et al.
5,235,928 A 8/1993 Shank, Jr.
5,238,537 A 8/1993 Dutt
5,243,925 A 9/1993 Fortenberry
5,262,230 A 11/1993 Becker et al.
5,355,819 A 10/1994 Hsia et al.
5,360,656 A 11/1994 Rexfelt et al.
5,391,424 A 2/1995 Kolzer
5,413,065 A 5/1995 Spragg et al.
5,421,128 A 6/1995 Sharpless et al.
5,431,970 A 7/1995 Broun et al.
5,482,763 A 1/1996 Shaffer
5,488,921 A 2/1996 Spragg
5,503,291 A 4/1996 Craig
5,505,557 A 4/1996 Bradley
5,544,612 A 8/1996 Eymard
5,657,714 A 8/1997 Hsia et al.
5,691,390 A 11/1997 Harrison et al.
5,713,399 A 2/1998 Collette et al.
5,735,083 A 4/1998 Brown et al.
5,780,144 A 7/1998 Bradley
5,790,304 A 8/1998 Sanders et al.
5,865,045 A 2/1999 Wagner et al.
5,902,070 A 5/1999 Bradley
5,921,421 A 7/1999 Fuquan
5,951,345 A 9/1999 Perratone et al.
6,003,565 A 12/1999 Whittier, II et al.
6,047,655 A 4/2000 Cran
6,056,438 A 5/2000 Bradley
6,086,968 A 7/2000 Horovitz
6,101,964 A 8/2000 Lesesne
6,290,818 B1 9/2001 Romanski

FOREIGN PATENT DOCUMENTS

EP 0 134 706 A 3/1985
EP 0 710 736 A1 11/1994
EP 0 687 625 12/1995
EP 0 862 870 A 9/1998
EP 0 832 032 B1 4/1999
FR 2 325 837 4/1977
FR 2595621 9/1987
GB 824 984 A 12/1959
GB 826 301 A 12/1959
GB 891121 3/1962
GB 907 266 10/1962
GB 933 889 A 8/1963
GB 1 079 766 8/1967
GB 1117552 6/1968
GB 1117553 6/1968
JP 60 219243 A 11/1985
WO WO 97/14622 A 4/1997
WO WO 97/49541 12/1997
WO WO 98/01359 A 1/1998
WO WO 01 63033 8/2001

OTHER PUBLICATIONS

International Search Report issued by the European Patent Office on Feb. 6, 2003 for PCT/US02/34299.
International Search Report issued by the European Patent Office on Feb. 10, 2003 for PCT/US02/34052.
International Search Report issued by the European Patent Office on Mar. 12, 2003 for PCT/US02/34004.
*McGraw-Hill Encyclopedia of Science and Technology, 6th Edition,* 1987, McGraw-Hill Book Company, New York XP00220369918, pp. 247-248 Paragraph 4; figures 6-8.
"3-D Braided Composites—Design and Applications" by D. Brookstein, 6th European Conference on Composite Materials, Sep. 1993, pp. 225-230.
Pages from web site of Bradley Textiles, Inc.
International Search Report issued by European Patent Office on Jul. 9, 2002 for PCT/US02/10694 filed Apr. 5, 2002.

* cited by examiner

END PORTION FOR A FLEXIBLE FLUID CONTAINMENT VESSEL AND A METHOD OF MAKING THE SAME

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and a method of making the same.

BACKGROUND OF THE INVENTION

The use of flexible containers for the containment and transportation of cargo, particularly fluid or liquid cargo, is known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, since a seamed structure is an alternative to a simple woven fabric and would have different advantages thereto, particularly in the fabrication thereof, it would be desirable if one could create a seamed tube that was not prone to failure at the seams.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips.

The length of fabric will be determined by the length of each spiral turn of the fabric strip of yarn material and its width determined by the number of spiral turns.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of non-woven material or of non-woven material with melting fibers.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

Furthermore, while as aforenoted, a seamless flexible container is desirable and has been mentioned in the prior art, the means for manufacturing such a structure has its difficulties. Heretofore, as noted, large flexible containers were typically made in smaller sections which were sewn or bonded together. These sections had to be water impermeable. Typically such sections, if not made of an impermeable material, could readily be provided with such a coating prior to being installed. The coating could be applied by conventional means such as spraying or dip coating.

Another problem is how to seal the end of the container, especially where tapering at the end is desired. End portions can be made separately and attached to the tubular structure, examples of which are set forth in the aforesaid applications and the references cited therein. It may also be desirable to have the end portions formed out of the tubular structure itself and formed into a desired shape (i.e. cone shaped etc.). In this regard, for example, U.S. Pat. No. 2,997,973 issued on Aug. 29, 1961 to Hawthorne shows the use of pleating of the fabric at the ends which are then glued and/or sewn to provide the desired shape.

Accordingly, there exists a need for a FFCV for transporting large volumes of fluid which overcomes the aforenoted problems attendant to such a structure and the environment in which it is to operate.

SUMMARY OF THE INVENTION

It is therefore a principal object of the invention to provide for a relatively large fabric FFCV for the transportation of cargo, including, particularly, fresh water, which has means of sealing the ends thereof in a desired manner.

It is a further object of the invention to provide means for sealing the ends of such an FFCV in conjunction with a tapering of the ends thereof.

A further object of the invention is to provide for a means for sealing the ends of such an FFCV so as to effectively distribute the load thereon.

These and other objects and advantages will be realized by the present invention. In this regard the present invention envisions the use of a woven, spirally formed or segmented tube to create the FFCV, having a length of 300 feet or more and a diameter of 40 feet or more. Such a large structure can be fabricated on machines that make papermaker's clothing. The ends of the tube, sometimes referred to as the nose and tail, or bow and stem, may be sealed by a number of means. End portions may be affixed to the tube, spirally formed or otherwise formed out of the tube itself. The present invention is directed towards a particular configuration for the end portions. In the case of a tube formed having a large uniform circumference of perhaps 130 to 245 feet or more, it would be necessary, however, to reduce the circumference down to a manageable size so as to allow an end cap or tow member to be affixed thereto. While doing so, it is desirable to taper the end portion tube such as that of a cone or the bow of a ship, while maintaining a unitized construction.

Once the end of the tube of the FFCV is reduced to a manageable circumference, an end closure mechanism is then affixed thereto. In this regard, the end closure mechanism comprises two interlocking parts each with conforming conical or curved surfaces between which the fabric is clamped. The mechanism, in addition to sealing the end of the FFCV, would also include interface features such as fluid flow ports for loading and unloading cargo along with a coupling mechanism for such loading and unloading. A towing hitch may also be part of this mechanism.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENT

Figure 1:
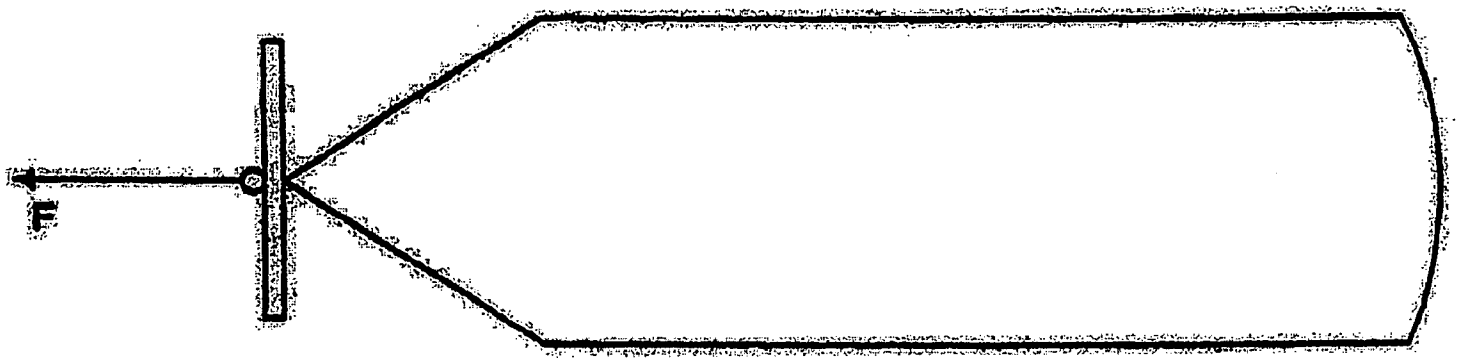
FIG. 1 PRIOR ART
FIG. 1 is a somewhat general perspective view of a known FFCV which is cylindrical having a pointed bow or nose.
Figure 2:
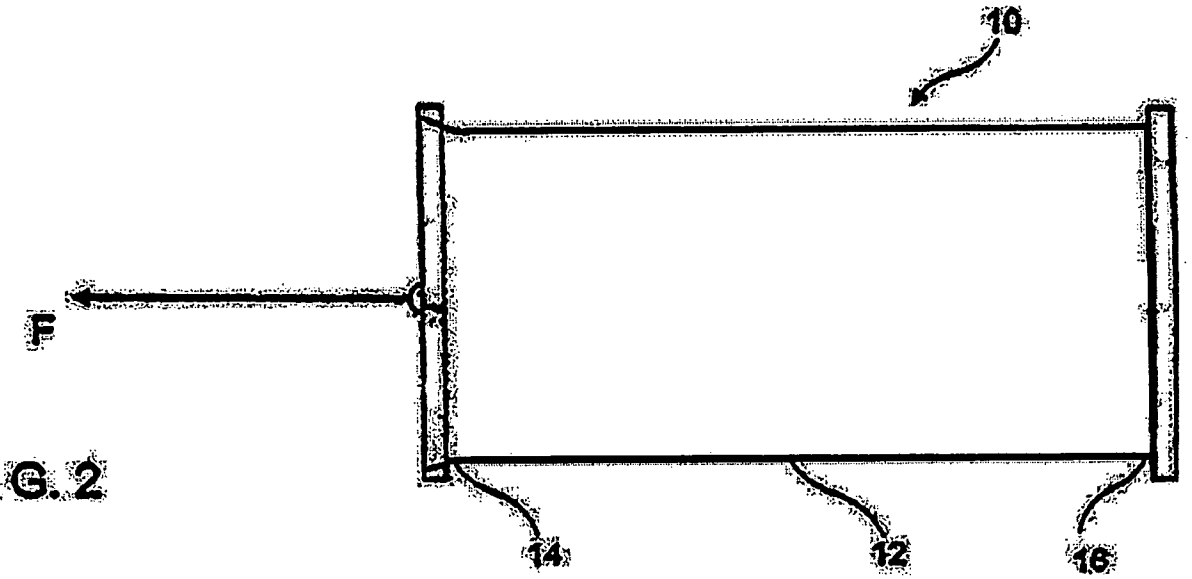
FIG. 2 is a somewhat general perspective view of a FFCV which is cylindrical having a flattened bow or nose.
Figure 3:
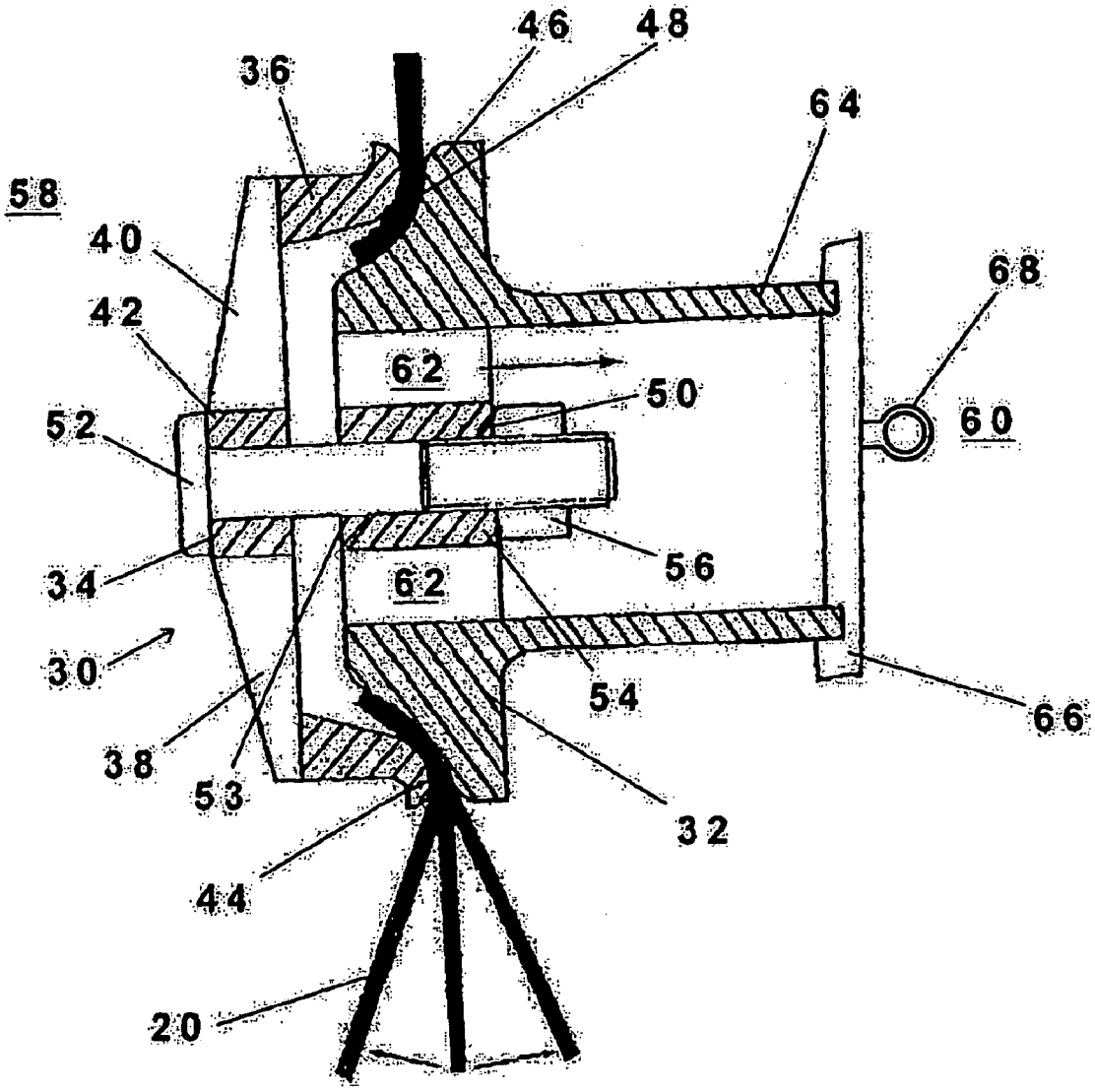
FIG. 3 is a side sectional view of the end closure mechanism incorporating the teachings of the present invention.

The FFCV 10 generally is intended to be constructed of an impermeable textile tube. While the tube or tubular structure 12 configuration may vary, the tube is shown generally (in FIG. 1) as being cylindrical having a substantially uniform diameter (perimeter) and then closed and sealed on each end 14 and 16. The respective ends 14 and 16 may be closed in any number of ways. As will be discussed it is a particular way of doing so to which the present invention is directed. The resulting impermeable structure should also be flexible enough to be folded or wound up for transportation and storage.

In designing the FFCV to withstand the loads placed thereon, certain factors should be considered. In this regard, in U.S. Pat. No. 6,860,218 entitled "Flexible Fluid Containment Vessel" such factors are set forth in detail, along with possible materials for the fabric, its construction and possible coatings and methodology to apply to it to render the fabric impermeable, in addition to other features which may be desirable with regard to the FFCV. Accordingly, further discussion thereof will not be repeated herein rather reference is made to said application.

Also, the present device may have application with regard to the spiral formed FFCV as disclosed in U.S. Pat. No. 6,675,734 entitled "Spiral Formed Flexible Fluid Containment Vessel".

In addition, reference is made to U.S. Pat. No. 6,739,274 entitled "End Portions for a Flexible Fluid Containment Vessel and a Method of Making the Same" which relates to possible construction of the end portions of the FFCV to which the present invention is directed to the particular configuration disclosed herein. Also, U.S. patent application Ser. No. 09/923,936 filed Aug. 7, 2001 entitled "Coating for a Flexible Fluid Containment Vessel and a Method of Making the Same" discloses additional constructions for the fabric in addition to possible coatings therefore.

While the aforesaid patent applications discuss the various forces important in the design of the FFCV, the present application is directed toward a particular means for closing the bow and/or stem of an FFCV. The present invention envisions a tapered structure so as to reduce the circumference to a manageable size by pleating or other means as disclosed in U.S. Pat. No. 6,739,274.

Figure 4:
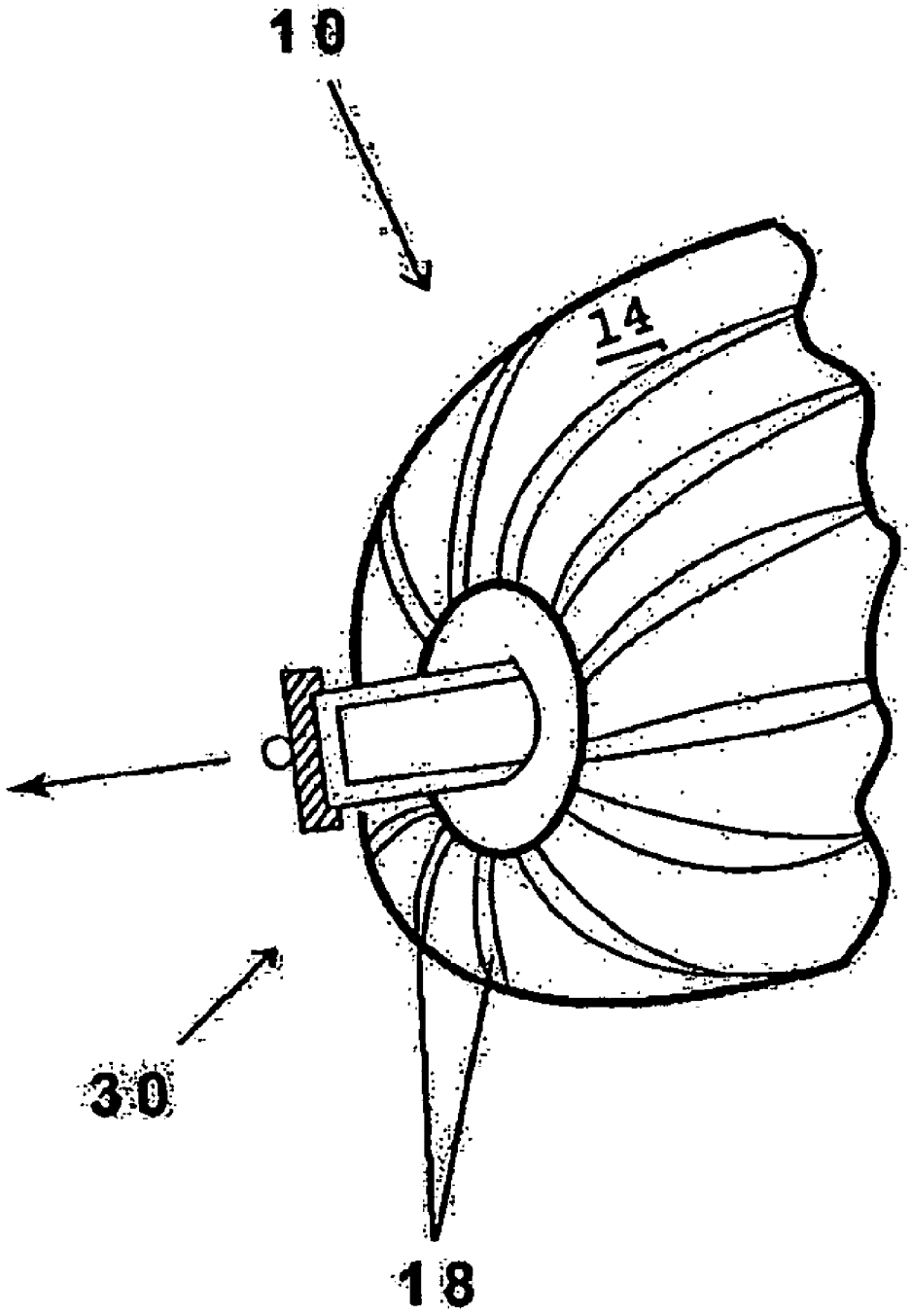
FIG. 4 is a partial prospective view of an FFCV with the mechanism as shown in FIG. 3, incorporating the teachings of the present invention.

The FFCV 10 includes a tube 12 and end portions generally designated 14 for the bow and 16 for the stem (not shown in FIG. 4). The construction shown allows one to convert a tube 12 into a cone shaped bow 14 and/or a cone shaped stem 16. Pleating, folding or other means disclosed in U.S. Pat. No. 6,739,274 allows one to convert the end of the tube 12 into a smaller diameter. The pleats 18, for example, may be formed about the circumference of the tube 12 so as to allow for the end of the tube 12 to become tapered or having a reduced circumference as shown in FIG. 4.

With this in mind, we turn now to the construction of the end closure mechanism 30 which can be used to close either or both ends of the FFCV. The mechanism 30 comprises two interlocking portions. There is a front or outward portion 32 and a rear or internal portion 34. The fabric 20 making up the tubular structure of the FFCV 10 would be pleated at the bow (and/or the stem) as shown generally by pleats 18 in FIG. 4. Portion 34 would be within the FFCV 10 and is circular in shape. It includes a continuous sealing ring 36 which is mounted upon a spider support member 38. Member 38 comprises a plurality of spokes or vanes 40 coupling ring 36 to an axial hub 42. Vanes 40 allow fluid to pass through portion 34 during the filling and emptying of the FFCV. Portion 34 is preferably made of a material which will not interact with the cargo which, depending upon its constituent, may be a high strength metal (i.e. stainless steel) or reinforced composite and is fabricated as a single piece.

Ring 36 includes a conical or curve portion 44 at its end. This curve portion 44 is intended to clamp fabric 20 against portion 32. In this regard, portion 32 includes a circular ring receiving portion 46. Portion 46 includes an annular curved or beveled surface 48 for matingly engaging curved portion 44 of ring 36. Located in the center of portion 32 is a clamping screw receiving member 50. In this regard, a clamping screw 52 is provided which passes through hub 42 and an axial opening 53 in member 50. A threaded portion 54 of screw 52 receives a nut 56 which is threaded down after the fabric 20 is positioned between portion 44 and surface 48.

After the tubular portion of the FFCV is appropriately pleated and the pleats sealed or otherwise bonded in place so as to reduce the end to the proper circumference, the clamping mechanism 30 is then placed thereon. Portion 44 and surface 48 create conforming conical surfaces between which the fabric is clamped. The tightening of screw 52 generates a seal between two sides of the fabric which is able to withstand a substantial pressure differential and prevents egress of fluid (e.g. from the inside 58 to outside 60 of the FFCV). If necessary, a sealant may also be used in this area to ensure that a sealing has occurred. The conical geometry generates higher compressive load in the fabric than a simple flat plate would with the same axial load and has a self-centering tendency when loaded.

The curved portion 44 of ring 36 protrudes into the higher pressure side (interior 58) of the fabric so that increasing fluid pressure gives rise to increasing sealing force between the fabric and surface 48. The curved portions are diverging and impart a gentle transition geometry which results in reduced stress concentrations in the fabric and improve durability of the fabric.

Note, the use of relief radii in the unclamped region of the mechanism 30 may also reduce localized tight geometry changes for a range of loading and movement conditions.

The required clamping force is generated by the application of simple linear load by a load bearing member or clamping screw 52. Other types of devices may also be used such as spring clamp with air or hydraulic release or an over-center locking device or other means suitable for the purpose.

Note that, since portion 32 will also be in contact with the cargo, it too, as well as any other components or surfaces in contact with the cargo, should be made of a material that does not interact with the cargo which, depending upon the constituent thereof, may be as aforesaid, high strength metal (i.e. stainless steel) or a reinforced composite material. Portion 32 has a number of fluid flow ports 62. These may be defined by vanes (not shown) which connect member 50 to ring receiving portion 46. In addition, portion 32 includes a tubular extension 64 having its interior in fluid communication with the fluid flow ports 62. Such extension 64 may be so configured to provide for sealing and porting with a filling or emptying device. A capping device 66 is affixed sealing the extension 64 off which may be opened to allow for filling or emptying of the cargo. A towing hitch 68 may be affixed to cap 66 or at other locations on the clamping mechanism 30 for securing a tow cable. This, of course, is only for illustration purposes and appropriate configuration and location(s) thereof will be apparent to one skilled in the art.

The aforesaid clamping mechanism has apparent attendant advantages. These include the ability to increase pressure on the fabric by the tightening of the load bearing member so as to increase the clamping force, if necessary. Also, reduced stress concentrations on the fabric are due to the relatively gentle geometry changes between the surfaces providing the clamping. Conventional sealing and hook up equipment may readily be incorporated, if necessary. In addition, the clamping surfaces can be modified for different applications. For example, it can be very shallow for flat surfaces of the fabric and more acute for higher compression loads or where elasticity of the fabric is a factor. Also, the configuration of the clamping mechanism may be such that the towing force thereon might be used to add to the clamping force generated, as will be apparent to one skilled in the art.

Although a preferred embodiment has been disclosed and described in detail herein, its scope should not be limited thereby; rather its scope should be determined by that of the appended claims.

What is claimed is:

1. A flexible fluid containment vessel for the transportation and/or containment of cargo comprising a fluid or fluidisable material, said vessel comprising:

an elongated flexible tubular structure having an interior and exterior and being comprised of fabric having a first circumference;

means for rendering said tubular structure impervious;

said tubular structure having a front end and a rear end;

means for filling and emptying said vessel of cargo;

wherein at least one of said front end or rear end is so formed so as to define an opening having a second circumference which is less than that of the first circumference; and clamping mechanism that includes a clamping device for closing said opening, said mechanism having a receiving portion in which said end is inserted between a ring portion having a radially extending member with a curved engaging surface which extends radially outward and a ring receiving surface having a corresponding geometry to said ring portion wherein said ring portion and said ring receiving surface remain rotationally fixed with respect to one another when an adjustable clamping force is exerted by the clamping mechanism clamping said end between said ring portion and said ring receiving surface thereby affixing said mechanism to said end and wherein said clamping device is disposed through an aperture in at least one of said ring portion and said ring receiving surface and which slidingly engages the at least one aperture in an axial direction.

2. The vessel in accordance with claim 1 wherein ring receiving surface includes a complementary curved surface to that of the radially extending member.

3. The vessel in accordance with claim 2 wherein said ring portion includes an axially located hub supported thereon, said ring receiving surface includes an axially located member which is axially aligned with said hub and a load bearing device coupled between said hub and said axial member so as to effect a load therebetween so as to provide a clamping force.

4. The vessel in accordance with claim 3 wherein said load bearing device is adjustable so as to adjust the amount of the clamping force.

5. The vessel in accordance with claim 3 wherein said ring portion and ring receiving surface include openings that allow the egress and ingress of fluid to and from the interior of the tubular structure.

6. The vessel in accordance with claim 5 wherein the ring portion is located on the interior and the ring receiving surface is located on the exterior with said ring receiving surface having means for closing off flow of fluid to and from the tubular structure.

7. The vessel in accordance with claim 6 wherein said clamping mechanism includes means for coupling a tow cable thereto.

8. The vessel in accordance with claim 6 wherein said clamping mechanism is made from metal or a reinforced composite.

9. The vessel in accordance with claim 3 wherein said clamping mechanism is located on the front end and rear end.

10. The vessel in accordance with claim 1 wherein said clamping mechanism includes means for coupling a tow cable thereto.

11. The vessel in accordance with claim 1 wherein said clamping mechanism is made from metal or a reinforced composite.

12. The vessel in accordance with claim 1 wherein said clamping mechanism is located on the front end and rear end.

* * * * *